US007568532B2

(12) United States Patent
Kuckes et al.

(10) Patent No.: US 7,568,532 B2
(45) Date of Patent: Aug. 4, 2009

(54) ELECTROMAGNETICALLY DETERMINING THE RELATIVE LOCATION OF A DRILL BIT USING A SOLENOID SOURCE INSTALLED ON A STEEL CASING

(75) Inventors: Arthur F. Kuckes, Ithaca, NY (US); Rahn Pitzer, Ithaca, NY (US)

(73) Assignee: Halliburton Energy Services, Inc., Houston, TX (US)

( * ) Notice: Subject to any disclaimer, the term of this patent is extended or adjusted under 35 U.S.C. 154(b) by 21 days.

(21) Appl. No.: 11/607,887

(22) Filed: Dec. 4, 2006

(65) Prior Publication Data

US 2007/0278008 A1 Dec. 6, 2007

Related U.S. Application Data

(60) Provisional application No. 60/810,696, filed on Jun. 5, 2006, provisional application No. 60/814,909, filed on Jun. 20, 2006.

(51) Int. Cl.
*E21B 47/01* (2006.01)
*E21B 47/022* (2006.01)

(52) U.S. Cl. ..... 175/40; 175/45; 166/255.2

(58) Field of Classification Search ..... 175/40, 175/41, 45, 61; 166/255.1, 255.2, 380, 66.5, 166/242.2, 242.6, 243; 324/346, 352, 355, 324/356

See application file for complete search history.

(56) References Cited

U.S. PATENT DOCUMENTS 4,443,762 A * 4/1984 Kuckes ..... 324/346
4,725,837 A * 2/1988 Rubin ..... 340/854.5
5,233,304 A * 8/1993 Hubans ..... 324/323
5,923,170 A * 7/1999 Kuckes ..... 324/326
RE36,569 E * 2/2000 Kuckes ..... 324/346
6,991,045 B2 * 1/2006 Vinegar et al. ..... 175/45
2004/0238166 A1 * 12/2004 Salamitou et al. ..... 166/255.1
2005/0247484 A1 * 11/2005 Brune et al. ..... 175/45
2008/0041626 A1 * 2/2008 Clark ..... 175/45

* cited by examiner

*Primary Examiner*—David J Bagnell
*Assistant Examiner*—David Andrews
(74) *Attorney, Agent, or Firm*—Conley Rose, P.C.

(57) ABSTRACT

Electrically powered electromagnetic field source beacons installed in a reference well in combination with a down-hole measurement while drilling (MWD) electronic survey instrument near the drill bit in the borehole being drilled permit distance and direction measurements for drilling guidance. Each magnetic field source beacon consists of a coil of wire wound on a steel coupling between two lengths of steel tubing in the reference well, and powered by an electronic package. Control circuitry in the electronic package continuously "listens" for, and recognizes, a "start" signal that is initiated by the driller. After a "start" signal has been received, the beacon is energized for a short time interval during which an electromagnetic field is generated, which is measured by the MWD apparatus. The generated magnetic field may be an AC field, or switching circuitry can periodically reverse the direction of a generated DC electromagnetic field, and the measured vector components of the electromagnetic field are used to determine the relative location coordinates of the drilling bit and the beacon using well-known mathematical methods. The magnetic field source and powering electronic packages may be integral parts of the reference well casing or may be part of a temporary work string installed therein. Generally, numerous beacons will be installed along the length of the reference well, particularly in the important oil field application of drilling steam assisted gravity drainage (SAGD) well pairs.

33 Claims, 8 Drawing Sheets

ELECTROMAGNETICALLY DETERMINING THE RELATIVE LOCATION OF A DRILL BIT USING A SOLENOID SOURCE INSTALLED ON A STEEL CASING

This application claims the benefit of US Provisional Application No. 60/810,696, filed Jun. 5, 2006 and of US Provisional Application No. 60/814,909, filed Jun. 20, 2006, the disclosures of which are hereby incorporated herein by reference.

BACKGROUND OF THE INVENTION

The present invention is directed, in general, to a method and apparatus for tracking the drilling of boreholes at a substantial depth in the earth, and more particularly to methods for determining the relative location of a reference well from a borehole being drilled through the use of a beacon located on the reference well casing.

The difficulties encountered in tracking and guiding the drilling of a borehole that is intended to intersect, to avoid, or to drill on a precise predetermined path to, a reference well at great depth below the surface of the earth are well known. Such guidance may be required, for example, when it is desired to construct a complex underground "plumbing system" for the extraction of underground gas, oil or bitumen deposits. Various electromagnetic methods for the precise drilling of such boreholes have been developed and have met with significant success during the past few years. Such methods and the instruments used are described, for example, in U.S. Pat. No. 4,323,848 and in U.S. Pat. No. 4,372,398, both issued to the applicant herein, and in U.S. Pat. No. 4,072,200 issued to Morris, et al. See, also, Canadian Patent 1,269,710 to Barnett et al, issued May 29, 1990.

Even though the guidance of boreholes with respect to existing wells is, in general, well developed, special problems can occur where existing techniques are not sufficient to provide the precise control that is required for that situation. For example, when it is desired to locate and to either avoid or to intersect a particular target well in a field that includes numerous other wells, problems can occur. Such a situation can occur when multiple wells lead from wellheads at a single location, such as a drilling platform, and it becomes necessary to drill a new borehole that avoids intersecting neighboring wells or, alternatively, to drill a new well for the purpose of intersecting a particular one. In this case, all the wells start at approximately the same location and spread downwardly and outwardly from each other. The new borehole being drilled may start at the same general location as the other wellheads, or may start at a location several hundred feet from the wellhead of a target well, and if intersection with, or avoidance of, a specific well, is desired, the problems of distinguishing between wells can be daunting.

Problems of tracking and guidance are also encountered when drilling non-parallel wells, such as drilling a horizontal well through a field of vertical wells, or vice versa, where it is desired to avoid the existing wells, or, in the alternative, where it is desired to intersect a specific well. Another area of difficulty occurs in the drilling of multiple horizontal wells, particularly where a well being drilled must be essentially parallel to an existing well. The need to provide two or more horizontal wells in close proximity, but with a precisely controlled separation, occurs in a number of contexts, such as in steam assisted recovery projects in the petroleum industry, where steam is to be injected in one horizontal well and mobilized viscous oil is to be recovered from the other. This process is described, for example, in Canadian Patent No. 1,304,287 of Edmunds et al, which issued Jun. 30, 1992. Another example is in the field of toxic waste disposal sites, where parallel horizontal wells are needed so that air can be pumped into one and toxic fluids forced by the air into the other for recovery. Still another example is in hot rock geothermal energy systems, where there is a need to drill parallel wells so that cold water can be injected into one and heated water recovered from the other. A further example is the drilling of boreholes for the pipeline industry, where the problem of connecting boreholes underground requires precise homing in from boreholes drilled, for example, from the opposite sides of a river.

The need to drill horizontal, parallel wells is of most immediate concern in the mobilization of heavy oil sands, where a borehole is to be drilled close to and parallel to an existing horizontal well with a separation of about five meters for a horizontal extension of a thousand meters or more at depths of, for example, 500 meters or more. A number of such wells may be drilled relatively closely together, following the horizon of the oil producing sand, and such wells must be drilled economically, without the introduction of additional equipment and personnel.

SUMMARY OF THE INVENTION

The difficulties that are encountered in the precise, controlled drilling of two or more boreholes in close proximity to each other are overcome, in accordance with the present invention, by apparatus for measuring the distance and direction between the two which includes a solenoid assembly installed at a first selected point in the first borehole, where the first borehole has a known inclination and direction at the selected point. The solenoid assembly includes electronic circuitry which actively waits for an initiating signal, and upon receipt of the initiating signal starts a prescribed electric current flow into the solenoid to generate a characteristic known solenoid field for a short interval of time. The initiating signal is sent from the surface by a drilling controller through a suitable communications apparatus. A magnetic field sensor is deployed at a second selected point in a second borehole, and measures three vector components of the characteristic solenoid magnetic field at the second point. Orientation circuitry for determining the spatial orientation of the magnetic field sensor is located at the second point in the second borehole. A processor responsive to the measured spatial orientation of the sensor and to the measured vector components at the second point in the second borehole, and further responsive to the characteristic known solenoid magnetic field is provided to determine the distance and direction between the first and second points.

The characteristic magnetic field is generated through the use of one or more electrically powered electromagnetic field beacons installed in the first well and is measured by a downhole measurement while drilling (MWD) electronic survey instrument in the second borehole. The first borehole may be a reference well, while the MWD instrument may be near the drill bit in a borehole being drilled. Each magnetic field source beacon consists of a coil of wire wound on a steel coupling between two lengths of steel tubing in the reference well, and powered by an electronic package. Control circuitry in the electronic package continuously "listens" for, and recognizes, a "start" signal that is initiated by the driller. After a "start" signal has been received, the beacon is energized for a short time interval during which an electromagnetic field is generated, which is measured by the measurement while drilling apparatus. Switching circuitry periodically reverses the direction of the generated electromagnetic field, and the measured vector components of the electromagnetic field are used to determine the relative location coordinates of the drilling bit and the beacon using well-known mathematical methods.

The magnetic field source and powering electronic packages are integral parts of the reference well casing or may be part of a temporary work string installed therein. In many cases, each beacon is energized only a few times in its lifetime and, in general, numerous beacons will be installed along the length of the reference well, particularly in the important oil field application of drilling SAGD (steam assisted gravity drainage) well pairs.

In accordance with a second aspect of the invention, a method for measuring the distance and direction between two boreholes extending into the Earth comprises the steps of installing a solenoid assembly at a first selected point in a first borehole, wherein the first borehole has a known inclination and direction at the selected point, and deploying a magnetic field sensor at a second selected point in a second borehole for measuring magnetic field and gravity vector components at the second point. The spatial orientation of the magnetic field sensor is determined, and electronic circuitry is provided in the solenoid assembly that actively waits for an initiating signal. A remote transducer sends an initiating signal under the control of the drill controller, and this starts a prescribed electric current flow into the solenoid to generate its characteristic known solenoid field for a short interval of time.

The method further includes sensing the vector components of the characteristic field with the sensor at the second point in the second borehole, and determining the distance and direction between the first and second points in response to the measured spatial orientation of the sensor and the measured vector components at the second point in the second borehole.

The method and apparatus of the invention intrinsically have a long range and, in addition, provide precision measurements, and have numerous applications.

BRIEF DESCRIPTION OF THE FIGURES

The foregoing objects, features and advantages of the present invention will be more clearly understood by those of skill in the art from the following detailed description of preferred embodiments thereof, taken with the accompanying drawings, in which.

DESCRIPTION OF PREFERRED EMBODIMENTS

Figure 1:
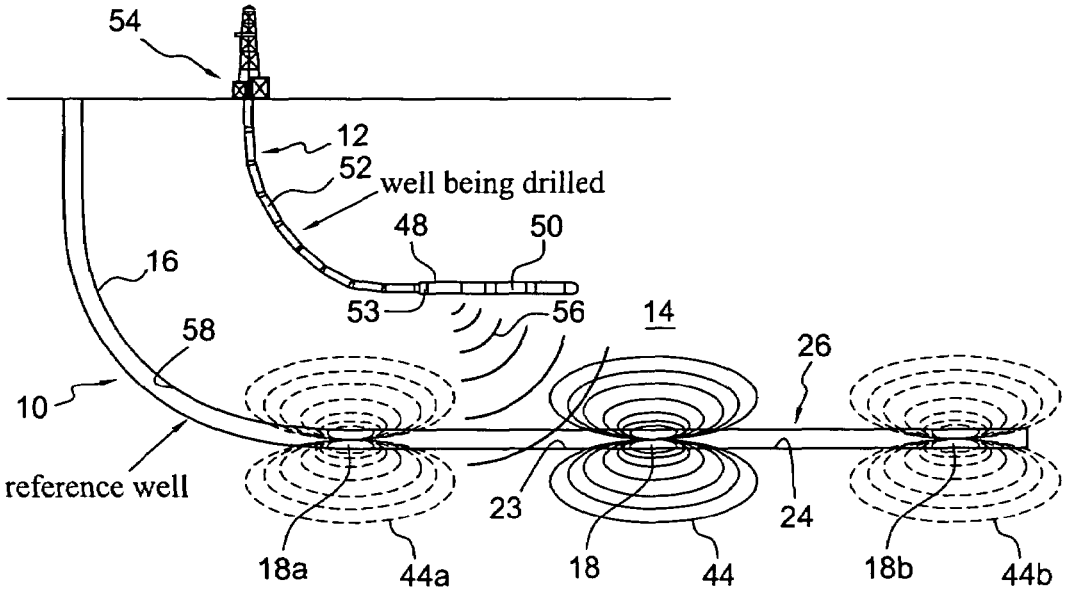
FIG. 1 is a schematic representation of the system of the invention as used in drilling a SAGD well pair.

Turning now to a more detailed description of the present invention, there is illustrated in FIG. 1 an overall view of a pair of wells 10 and 12 in an oil field 14 for use in SAGD (steam assisted gravity drainage) production of oil from a non-flowing bitumen hydrocarbon formation. As illustrated, well 10 is a previously drilled and cased horizontal well which serves as a reference well, while well 12 is being drilled along a path that is near, and parallel to, a horizontal portion of the first well. In this important SAGD application, steam will be injected into the upper well 12 to melt the bitumen to allow it to flow to the lower well 10, from which it is pumped to the Earth's surface. An important specification of such a well pair is that the horizontal portions of the pair, which are located in the hydrocarbon formation, must be precisely parallel to each other, with a precisely specified separation. Typically, the well pair will have a horizontal reach of 1.5 km with a separation specified to be 5+/−1 meters over that length. An important improvement offered by this invention, over prior methods in use, is that no access to the first "reference" well is required while the second well is being drilled.

The reference well 10 is drilled using conventional drilling tools, which usually consist of a drilling motor and a rotatable, steerable drilling assembly with an electronics control package, such as is found in a measurement while drilling (MWD) system. This first well is drilled along a prescribed course using conventional guidance techniques and is then cased with steel tubing, generally indicated at 16. In accordance with a preferred form of the present invention, during the casing operation one or more electromagnetic beacons 18, each incorporating a casing coupler, to be described, are installed between lengths of casing in this well at prescribed locations. A "casing crew" installs these beacon couplers in the same way that ordinary pipe couplings are installed, although the beacon couplers may have a specified "down hole" polarity orientation. These couplers may be installed as permanent sections of the reference well casing 16 or as couplings in a temporary "work string" of tubing, to be described, installed inside the reference well.

Within a few months after casing has been installed in the reference well, the second well 12 of the pair is drilled along a specified parallel path with respect to well 10. The electromagnetic beacons of the invention are energized while drilling this second well to give the driller periodically measured, updated, location ties to the reference well to keep the new well from veering off course. In drilling a borehole it is standard practice for the driller to periodically make drill bit orientation and direction determinations using MWD measurements of the Earth's magnetic field and the direction of gravity while a new length of drill pipe is being attached to the drill string. It is during such times that an electromagnetic beacon in the reference well can be given a start signal to briefly turn it on to allow measurements of the beacon's electromagnetic field components at the well being drilled to be made at the same time that other measurements are being made. Measurements of this beacon electromagnetic field may utilize the techniques disclosed in U.S. Pat. No. 6,814,163. After making a determination of relative position and drilling direction based on these measurements, the drilling direction for the next drilling interval for well 12 is adjusted to make course corrections, as needed.

Figure 2:
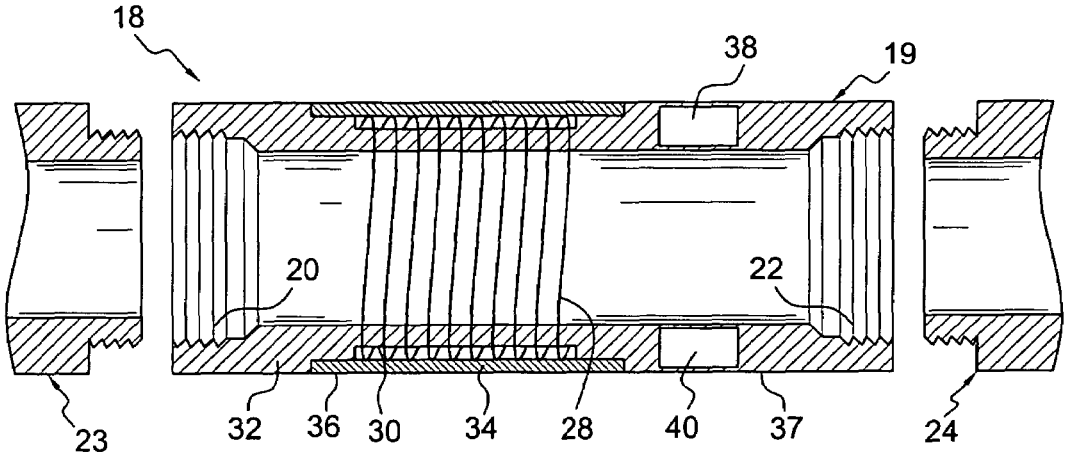
FIG. 2 is a schematic representation of the solenoid and electronics package of the system of FIG. 1, mounted on a length of well casing.

An electromagnetic beacon 18 for use in a SAGD application is illustrated in cross-section in FIG. 2. The beacon incorporates a coupling 19 which may be, for example, a threaded steel pipe approximately 3 feet long with female threads 20 and 22 at its opposite ends. This coupling 19 is used to couple two standard lengths, typically 40 feet, of 7-inch diameter slotted liner casing segments 23 and 24. Several beacons 18, 18*a*, 18*b*, etc., may be used to couple corresponding casing segments end-to-end to form the production portion 26 of well 10 at the lower end of the well, as illustrated in FIG. 1. The beacons 18, 18*a*, 18*b*, etc., are totally self-contained, and install as ordinary casing couplers. The beacons are structurally similar, and as illustrated in FIG. 2 for beacon 18, each incorporates a coil 28 that is wound around the circumference of the body of the coupling 19, preferably in a groove 30 formed in the coupling sidewall 32, Preferably, the coil is impregnated with epoxy and is covered with fiberglass or Kevlar. In addition, the coil may be protected by a nonmagnetic, stainless steel protective cover 34 that is fitted in a corresponding indentation 36 in the sidewall 32, so that it is flush with the outer surface 37 of the sidewall. An electronics package, start sensor and battery pack are "potted" with epoxy in small cavities 38 and 40 on the circumference of the coupling 19, completing the electromagnetic beacon 18. After installation, each of the beacons waits for a corresponding initiating, or "start" signal, upon receipt of which the selected beacon generates a corresponding electromagnetic field, indicated respectively by field lines 44, 44*a*, and 44*b* in FIG. 1. The field is produced for a short duration, or burst, sufficient to allow the desired measurements at the MWD tool 48.

In one example, the main electromagnetic field generating coil 28 was about 20 inches long, and consisted of a single layer with 500 turns of #18 gauge magnet wire wound on the 7 inch diameter coupling 19 to form a solenoid. The coil was thoroughly impregnated with epoxy and was covered with a protective fiberglass layer approximately ⅛ of an inch thick. If desired, a Kevlar layer could be used instead of the fiberglass. A further, non-magnetic stainless steel cover 34 was installed, although in most cases this will not be necessary. The lengths of steel casing 23 and 24 extending from respective ends of the coupling become an integral part of the ferromagnetic core of the solenoid so that the electromagnetic pole separation of the solenoid is much greater than the coupling length.

Transmission of a "start" signal to cause a selected beacon unit to begin operation may employ any one of a number of methods. A simple one is to provide a sonic source in the MWD equipment in the well being drilled. As illustrated in FIG. 1, the MWD equipment 48, located on a drilling tool 50 carried by drill stem 52 in well 12, includes a sonic source 53 that can be activated to cause a sonic burst to be transmitted from the MWD site. In this case, the MWD unit includes as sensor to detect encoded drilling fluid pressure pulses that are initiated in known manner from the driller's console 54 located, for example, at a well drilling derrick at the Earth's surface. The generation of coded pulses may utilize a well-known technique that includes turning the conventional drilling fluid pumps on and off to produce pressure pulses in the drilling fluid in a prescribed, coded manner. The MWD unit then responds to the received fluid pulses to send a sonic burst, illustrated at 56 in FIG. 1, to the electromagnetic beacons in the well 10. The sonic burst may be encoded to turn on only a selected one of the beacons 18, 18*a*, 18*b*, etc., and the sonic sensor in the electronics package carried in cavities 38 or 40 of the selected beacon operates to turn on the power supply for the solenoid coil 28 to produce the corresponding one of the electromagnetic fields 44, 44*a*, 44*b*, etc.

In many SAGD drilling operations, an electromagnetic communication system is used instead of a pressure pulse system to communicate data between the Earth's surface and the MWD unit in the well being drilled. In this case, electrical signals are transmitted along the drill stem 52 and are detected by the MWD unit. If desired, these signals may be used to start a beacon by encoding them to activate a corresponding sonic transmitter in the MWD unit to produce a pulse, or burst, 56 for detection by the beacons in the reference well 10 and to activate a selected beacon.

Figure 3:
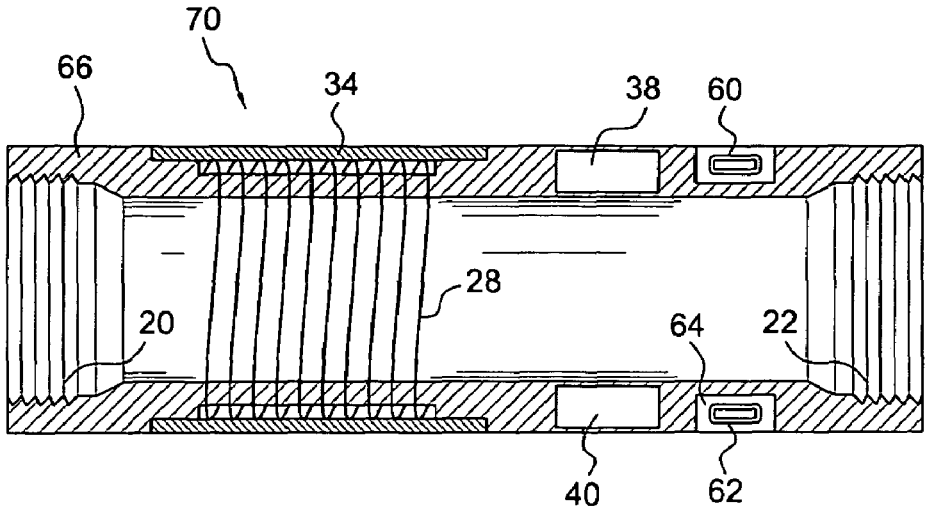
FIG. 3 is a schematic representation of a casing current sense winding with electromagnetic switching to initiate turning on the solenoid of FIG. 2.

Alternatively, it is a relatively simple matter to incorporate a magnetic field sensor in each beacon to permit activation of a selected beacon by magnetic fields produced by current in the drill stem 52 in well 12, or to permit activation of a selected beacon by signal currents in the casing string 58 of the reference well 10, which is made up of end-to-end coupled casing segments such as the segments 23 and 24, as described above. For this purpose, and as illustrated in FIG. 3, such a magnetic field sensor may include a toroidal transformer sensor winding 60 on a high permeability, permalloy core 62 wound in a groove 64 around the circumference of a beacon coupling 66, which is otherwise similar to the beacon 18. The toroidal winding 60, which may also be impregnated with epoxy and covered by fiberglass or Kevlar, serves as a magnetic pickup, or sensor, coil to detect the magnetic fields produced by encoded alternating current flow along the drill string 52 or the reference well casing string 58. This sensor coil is connected through a low power, low noise amplifier to the electronics package in cavity 38 or 40, and this amplifier is connected to the transmitter coil 28, which is the same as the coil described above with respect to FIG. 2, to produce the modified beacon 70 illustrated in FIGS. 3 and 4. It will be understood that similarly numbered items in FIGS. 1-4 are the same.

When a coded "start" signal is sent electromagnetically along the drill stem 52 from the driller's console 54, it is detected by the MWD apparatus 48 (FIG. 1) to provide control signals for the drilling tool. In addition, the current in the drill stem 52 produces a circular magnetic field 72 surrounding the drill stem, and this field is detected remotely by a beacon in the casing of the reference well, such as the beacon 70, to turn the beacon on.

Figure 4:
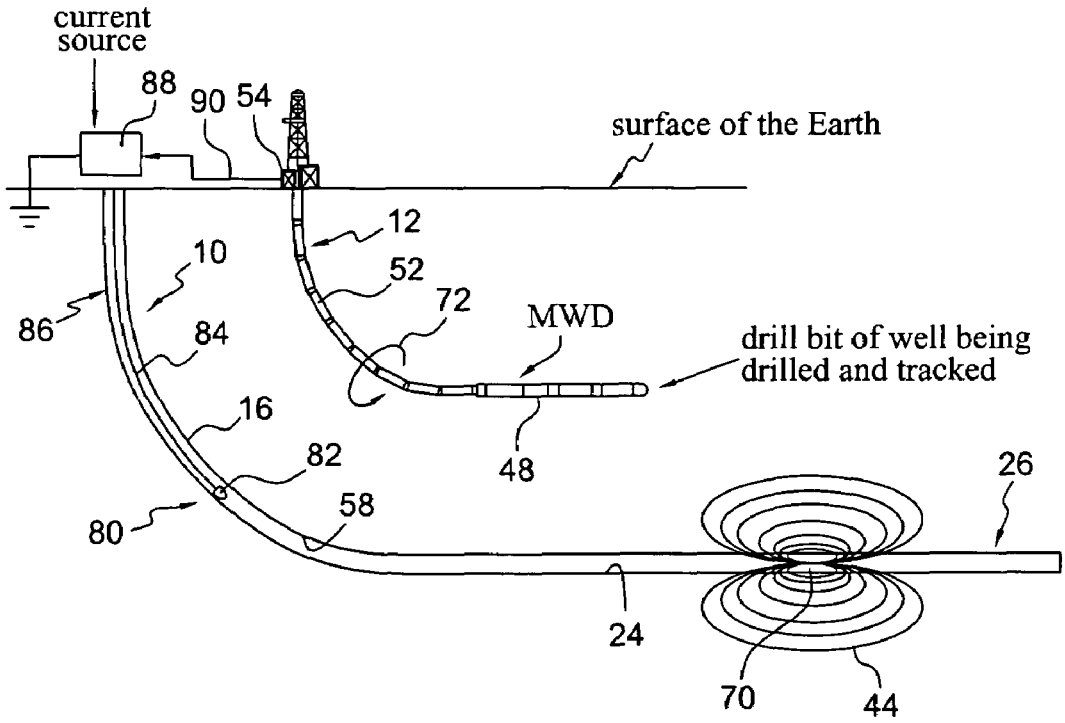
FIG. 4 is a schematic representation of a SAGD well pair showing a beacon with electromagnetic communication, with a current injection source to send an encoded "start" signal.

Instead of integrating the electromagnetic communication circuitry for controlling the operation of the beacon with the software of the MWD instrument 48, it may often be advantageous to have an independent beacon communication system, such as that illustrated at 80 in FIG. 4, which will operate in conjunction with the beacon 70. Providing such an independent system for the SAGD application disclosed herein can be as simple as lowering an electrode 82 on an electrically insulated wire line 84 down the approximately vertical portion 86 of the reference well 10 and allowing the electrode to make contact with the reference well casing 58. At the earth's surface, the wire line 84 is connected to a current source 88 that is capable of injecting a digitally encoded signal of a few amperes of current at a frequency of, for example, approximately 10 Hertz into the well casing 58 by way of electrode 82, this current flowing along the casing for detection by a winding 60 in beacon 70. Reliable detection by the toroidal pickup winding 60 requires only a very small current, so it is only necessary that a small fraction of the current injected into the casing by electrode 82 pass through the coupling 66 and thus through the permalloy strip, or core 62, of the sensor coil 60. The receiving electronics package in cavity 38 or 40 on each beacon 70 included in the casing responds only to its prescribed digital code, which is encoded in a "start" signal initiated at the drilling console 54 and which controls the current source 88 by way of control line 90. Once a specified beacon has received a "start" signal, the electronics package in the beacon activates the solenoid winding to produce a corresponding magnetic field 44 in the vicinity of the reference well casing string at the location of the beacon.

Figure 5:
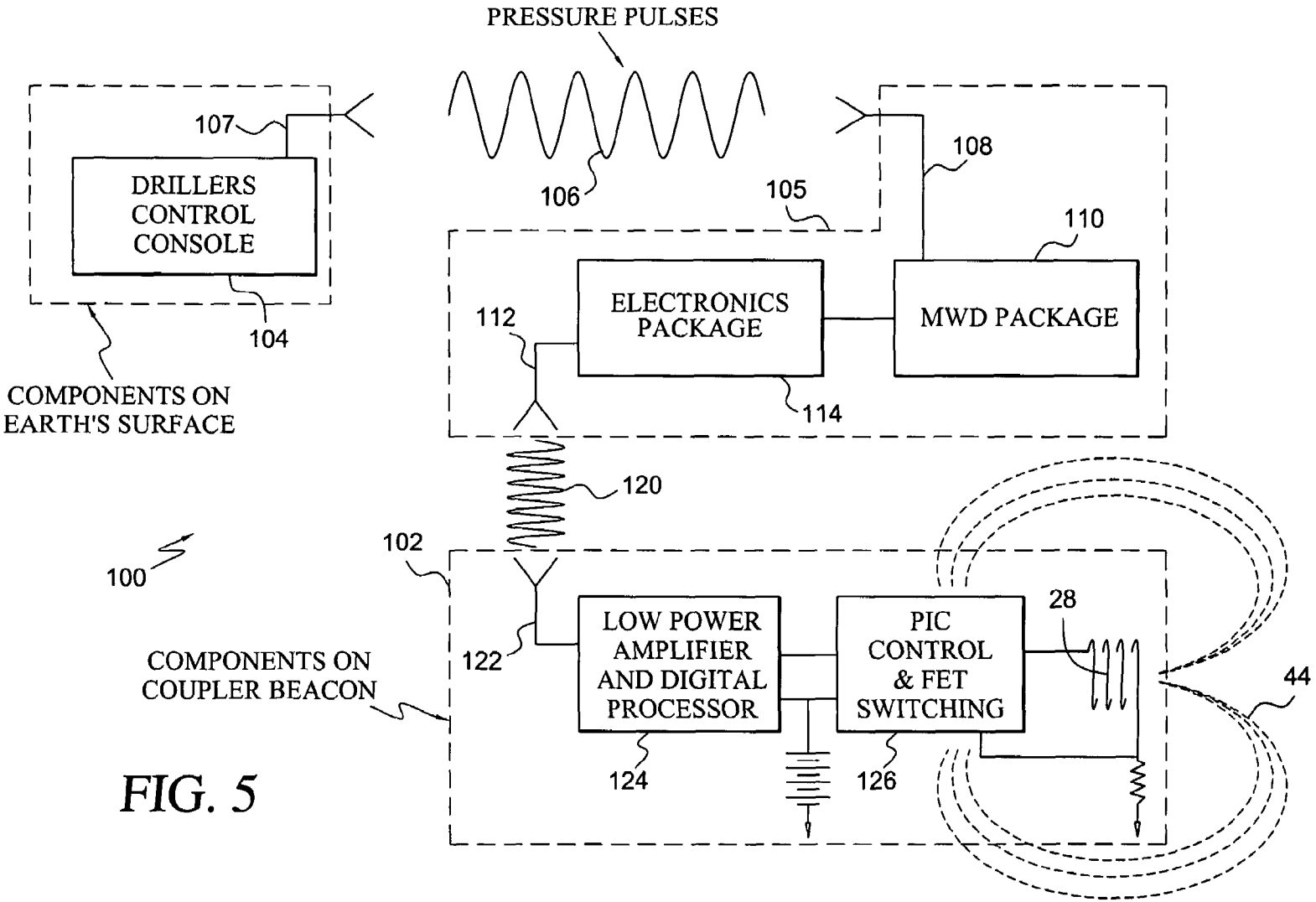
FIG. 5 illustrates an overall layout of a SAGD drilling system with sonic start.

An overall drilling system 100 incorporating a coupler beacon 102, which is similar to the beacons described hereinabove in accordance with the present invention, is illustrated in FIG. 5. In the illustrated system, which is exemplary of one of the embodiments of the invention, a driller's console 104 on the earth's surface is capable of transmitting, receiving and processing data for controlling a drilling operation in known manner. To communicate with down hole equipment 105, the controller transmits and receives data pressure pulses 106 by way of pressure transducers 107 and 108 at the controller and at the down hole equipment, respectively. The pulses 106 travel in the drilling fluid inside the drill string of the well being drilled. Pulses transmitted from the surface transducer 107 are received by the down-hole transducer 108 and sent to a conventional MWD package 110 carried by the drill. Such pressure waves can also be generated by "jars" in the drilling string in the well being drilled. Jarring tools are included in most bottom hole drilling assemblies to allow the driller to free the drilling bit in case it gets stuck.

A sonic transducer 112 in the down hole equipment 105 is connected to the MWD package 110, for example by way of an electronics package 114 that includes a sound generator and sound sensor, as well as electromagnetic field sensors for detecting the field generated by the beacon 102. The electronics package 114 includes a processor that responds to the coded signals received from the control console 104 by the MWD package 110 to produce a corresponding sonic pulse 120. The sonic pulse, or burst 120, that is initiated from the down hole equipment 105 in the well being drilled travels through the intervening geologic formations, is detected by a transducer 122 on the beacon 102, and is received by a receiving amplifier and processor 124 at the beacon. A sonic burst about 1 second long will, in many cases, be sufficiently long to communicate with the beacon. This enables the use of a very low power receiver 124 that will have a narrow bandwidth for rejecting the broad band, intense noise generated by the drill bit while drilling is actually in progress. In the preferred form of the invention, each of the beacon receivers remains in standby continuously from the time the beacon is installed in the casing string, waiting for an initiating burst. In most cases it is advantageous to have simple encoding in this burst to ensure that only a specified beacon is turned on.

As described above, the sonic burst 120 is initiated by the driller from the driller's console 104 by turning the drilling fluid pumps on and off in a prescribed way. This sends pressure pulses 106 from transducer 107 down the drilling fluid in the drill string, which are sensed by the down hole transducer 108 connected to the MWD unit 110 and the electronics package 114 to produce corresponding sonic signals 120. The selected beacon responds to the sonic burst to briefly energize the solenoid windings 28 on the beacon with encoded polarity and solenoid current as described above, to produce a corresponding electromagnetic field 44. Electromagnetic sensors in the MWD package 110 or in the electronics package 114 connected to the MWD package receive, signal average, and process three vector components of the alternating electromagnetic field 44 produced by the solenoid. Measurement while drilling tools manufactured by Vector Magnetics LLC, Ithaca, N.Y., incorporate the required electromagnetic field sensing elements for AC field measurements; however, most off the shelf standard MWD packages are programmed to only measure the Earth's magnetic field and the three vector components of the gravity. Therefore, to incorporate the AC capability required to measure the AC field 44 produced by the beacon, it is necessary either to reprogram the processing electronics of such standard tools or to provide the "add-on" AC unit as schematically indicated at 114 in FIG. 5.

An electronics package 126 is carried by the beacon 102, for example in cavities 38 or 40 as described above, and includes a standard Peripheral Interface Circuit (PIC) and a field effect transistor (FET) circuit to put about 1 ampere of current into the solenoid coil 28 for about 10 seconds at a current reversal frequency of about 2 Hertz. The number of field reversals is conveniently made inversely proportional to the current injected into the coil so that the product of the magnetic moment generated and the time of excitation is constant, thereby keeping the integrated electromagnetic signal a fixed quantity even though the battery voltage may vary with current load and age. The current polarity of the first current flow half cycle can be used to define the polarity of the electromagnetic field.

Four or five "AA" alkaline batteries are capable of generating a magnetic moment of about 200 amp meters$^2$; this is ample for range determination to at least 30 meters away. An ampere of current flow from an "AA" alkaline battery loads it from an open circuit voltage of about 1.56 volts to about 1.3 volts. Such a battery is rated at about 0.5 ampere-hours. Tests also indicate that such batteries and the integrated circuits being used can operate while subject to at least 3,000 psi of pressure without a protective sonde enclosure. Thus the typical requirements for many SAGD applications are readily met.

Once a beacon comes into range so that its magnetic field can be detected by the MWD tool of a well being drilled, relative distance determinations between the well bores are made to establish a surveying tie point. Then drilling continues, preferably using conventional drilling techniques, to the next beacon, which may be 100 or more meters down hole.

The signal averaged electromagnetic field vector components detected at the MWD package, along with the Earth field and accelerometer data obtained by the MWD tool and used to determine the azimuth, inclination and roll angle of the drilling assembly, are sent up-hole to the driller's console, using transducers 108 and 107 to send and receive pressure pulses 106 in the drilling fluid in known manner.

In general, the design of battery-powered beacons using the principles described herein to provide an alternating magnetic field and AC detection methods is much easier than using DC methods; in addition, AC methods give much greater range for a given amount of electrical power than would a DC beacon. DC beacon excitation using battery power is feasible, however, for it is often advantageous to use standard, off the shelf MWD drilling equipment, which has the capability of measuring only Earth magnetic field vectors.

The use of a DC magnetic field source in a drill guidance system is described in U.S. Pat. No. Re. 036,569, wherein a direct current generated electromagnetic field is activated for a short time interval at one polarity and then for a short time interval at the other. The apparent Earth magnetic field is measured during each time interval. By subtracting the three vector components of the apparent Earth field measurements in the two cases, the electromagnetic field vector received from the DC magnetic field can be found. The processed three vector components of the received electromagnetic field are incorporated into the data stream of the standard MWD package and are transmitted to the driller using standard drilling fluid pressure pulse technology where they are further processed.

Figure 6:
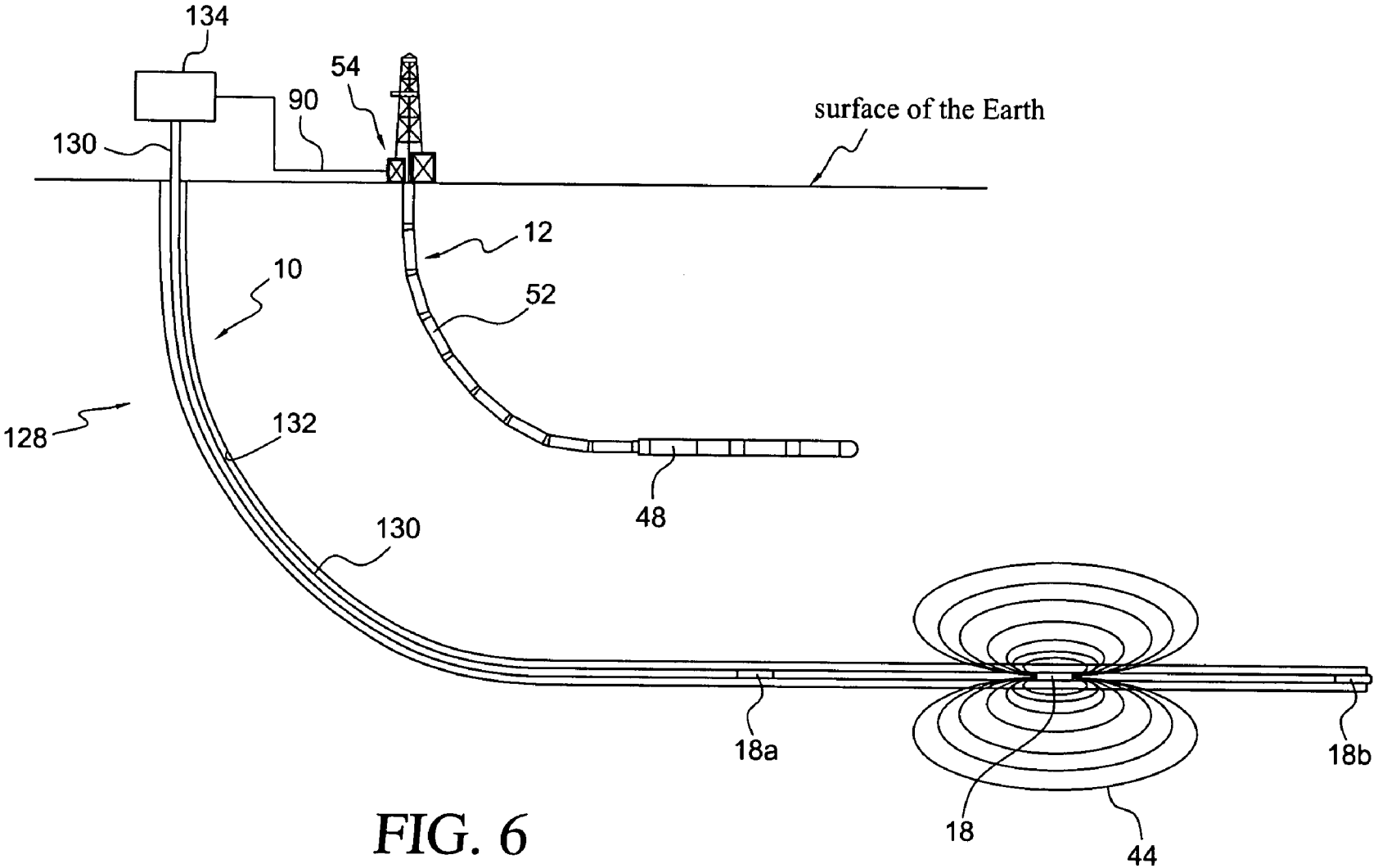
FIG. 6 illustrates a SAGD well pair with a coupling beacon source installed on a tubing work string.
Figure 7:
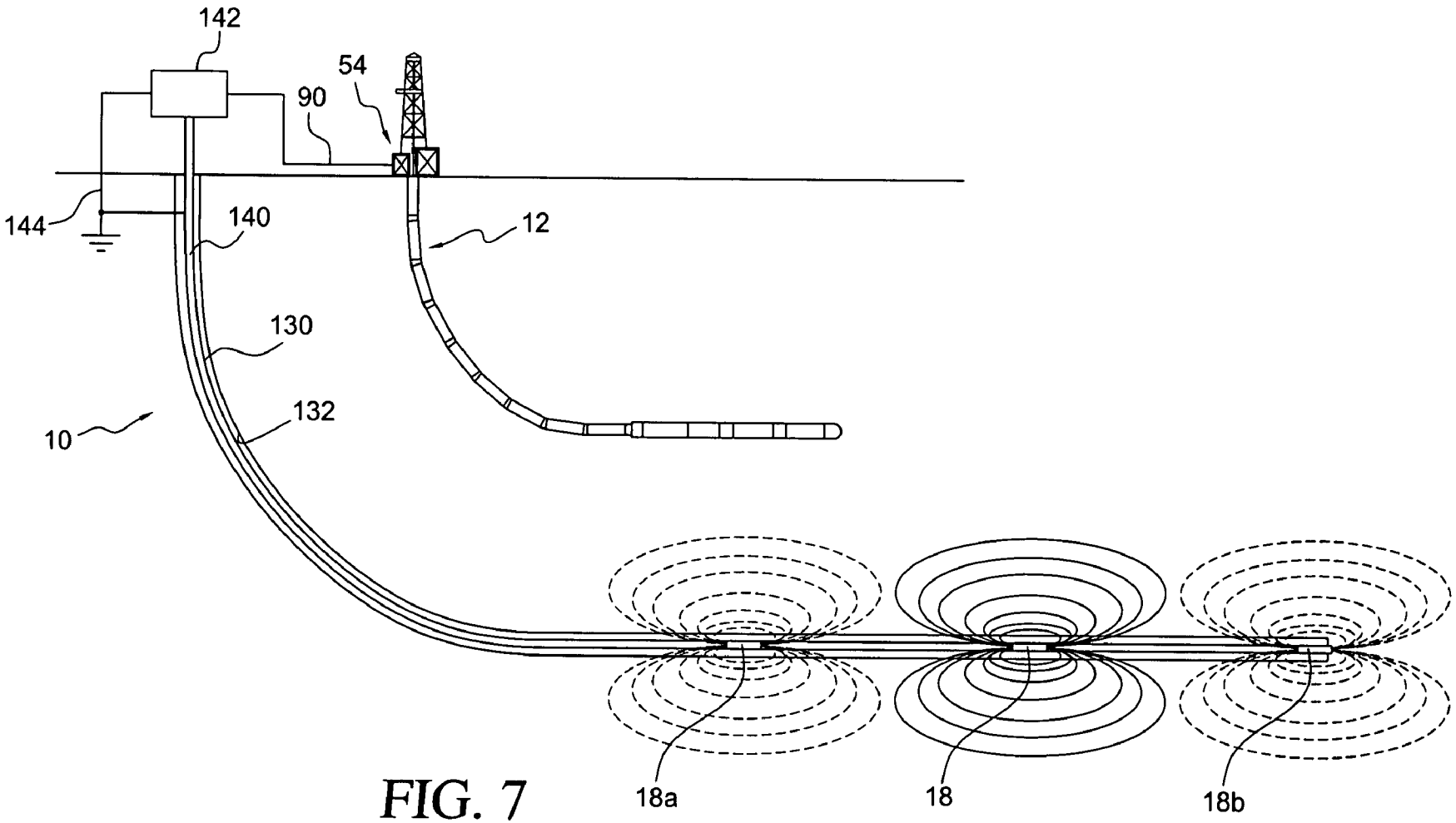
FIG. 7 illustrates a SAGD tubing work string with multiple sources, with an insulated wire to power and to communicate with the beacon sources.

Several variations of the invention that are particularly suited to DC solenoid excitation of the above-described apparatus are illustrated in FIGS. 6 and 7. In the embodiment of FIG. 6, wherein elements common to prior Figures are similarly numbered, a beacon system generally indicated at 128 incorporates an ensemble of beacon coupling sources, such as the beacons 18, 18*a*, and 18*b*, which is assembled as part of a temporary "tubing work string" 130. In this application, the work string 130 may consist of sections of 2.875 inch diameter pipe coupled end to end by multiple self contained, installed beacons 18, 18*a*, 18*b*, etc., and the string 130 is temporarily deployed inside a reference well casing 132 shortly before drilling of the second of the well pair is begun. After drilling of the second well 12 is finished, the work string 130 is pulled out and the coupling beacons are retrieved. In this deployment, space for batteries and electronics is not an issue since the entire volume inside the work string is available, and making a reversible direct current, strong solenoid source becomes much easier. This method avoids the need for a separate wire line such as the line 84 described above, and since the work string 130 remains in place in the reference well throughout the drilling of well 12, it is not necessary to keep well tractor crews available during the entire drilling operation to successively deploy either a solenoid, as disclosed in U.S. Re. Pat. No. 036,569, or sensing instruments, as disclosed in U.S. Pat. No. 5,589,775 in the horizontal reference borehole.

The work string 130 can carry communication signals such as those described with respect to the system of FIG. 4, wherein an electrode 82 supplies current to the casing for detection by the down hole toroidal pickup winding 60. However, avoiding the installation of electrical wires between the surface and the beacons is usually desirable. Thus, a communication system to remotely initiate operation of a battery-powered beacon may be advantageous even when temporary work strings are utilized. Sonic waves transmitted from the MWD site, as described with respect to FIG. 5, is a way of doing this.

Another embodiment is illustrated in FIG. 6, wherein a pressure transmitter 134 is mounted at the surface end of the tubing work string 130 or at the surface end of the casing 132 in the reference well 12. This transmitter may "hammer" the work string or casing tube, thereby sending percussive, or compression, shock waves down the work string 130 or the casing 132.These waves may carry encoded start signals which are then sensed by piezoelectric, geophone or hydrophone transducers in the individual beacon couplers 18, 18*a*, 18*b*, etc. to activate the electromagnetic field generating circuitry in the selected beacon. Pressure pulses with encoding may also be initiated in fluid in the reference well 10, or by pressure pulses generated in the well 12 being drilled in the manner described above, and sensed by the individual beacons carried by the work string 130 in the cased reference well.

As illustrated in FIG. 7, it is sometimes possible to install an electrically insulated wire 140 in the reference well, particularly inside a temporary tubing string 130, both to power and to communicate with an ensemble of down-hole beacons, such as the beacons 18, 18*a*, 18*b*, etc. When this is done, it is usually desirable to use a single conductor electrical system connected to a current source 142 at the surface. This source may be an AC control current source or a DC source, with the tubing 130 or the casing 132 being used for the current return illustrated at 144. The configuration shown in FIG. 7 depicts the wire 140 inside the work string 130, which carries a few amperes of current for powering the beacons and telemetry signals for communicating with individual beacons.

Figure 8:
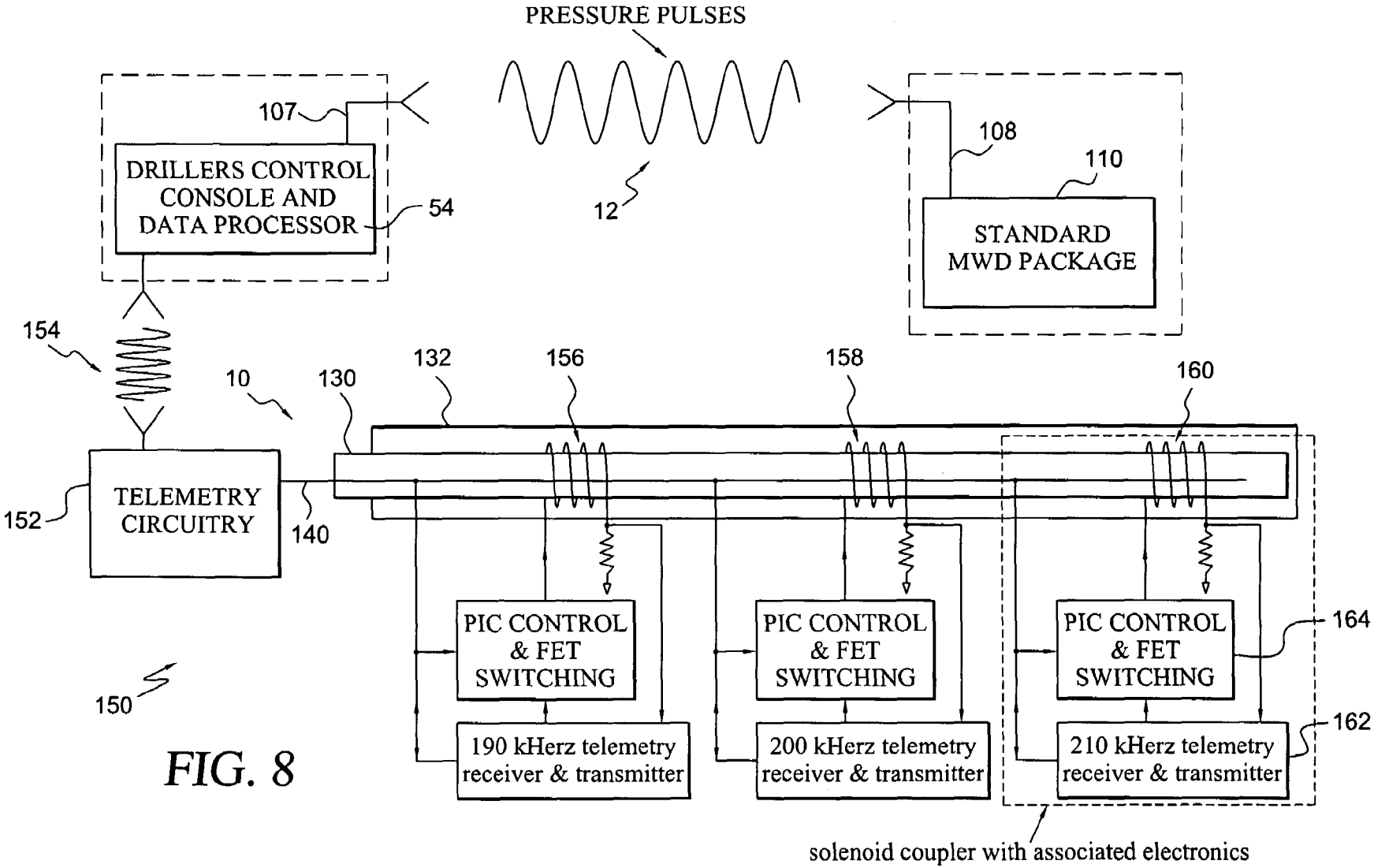
FIG. 8 illustrates an overall drilling system layout of a SAGD drilling system with a work string and insulated wire inside work string.

An overall electronic and computer control system 150 for use with the apparatus of FIG. 7 is illustrated in FIG. 8. The driller's console 54, the drilling fluid pressure pulse communication system including transducers 107 and 108, and the MWD hardware 110 is similar to that in common use, and is described above. The MWD software is programmed to sequentially make two measurements of the apparent Earth magnetic field as the well is being drilled. After drilling is stopped and a survey measurement is to be made, the driller activates telemetry receiving and transmitting circuitry 152 at the surface location of the reference well 10, as by way of a connector 90, described above with respect to FIGS. 4 and 7, or by way of a radio link 154, illustrated in FIG. 8, to apply a high frequency telemetry signal of approximately 200 kiloHertz to the insulated wire 140 inside the work string 130. An ensemble of beacons 156, 158, 160, etc., each similar to the beacon 18 described above, is connected in the work string 130, and each has telemetry communication electronics, such as the electronics package 162 illustrated for beacon 160, set to receive its own frequency. For example, in the apparatus depicted in FIG. 8, beacon 156 listens for a 190 kiloHertz signal, beacon 158 listens for a 200 kiloHertz signal, and beacon 160 listens for a 210 kiloHertz signal, etc. Each telemetry package responds to its corresponding coded telemetry signal to activate its corresponding PIC control and FET switching circuit, such as the circuit 164 for beacon 160, to activate the selected beacon. The driller is thereby able to turn on a specified beacon, with specified polarity and period of excitation. The power for that excitation is carried simultaneously by insulated wire 140 either as a direct current, a programmed polarity direct current or as an alternating current.

As described above, each beacon thus has a self contained electronics package which includes not only the peripheral interface controller (PIC), but solenoid current regulating and measuring circuitry and telemetry that is capable of applying to the solenoid the excitation currents that are required. In this way, either alternating current may be applied directly to the beacon or a "positive" direct current of a few amperes may be applied for approximately 10 seconds, during which time the MWD unit on the drilling assembly makes an apparent Earth field measurement. This is followed by a similar "negative" current excitation and measurement. Subtracting the measured apparent Earth magnetic field measurements from each other yields the vector components of the electromagnetic field generated by the beacon, while averaging the two measurements gives the vector components of the Earth's magnetic field. The measurements are transmitted to a data processor, which may be a part of the driller's control console 54, where the location and drilling direction of the well 12 are then computed and the drilling direction adjusted for the next course length, after which similar measurements are made. After a given beacon lies too far behind the drilling location to give precise enough results, drilling proceeds using the usual non-beacon guided methods until the next beacon comes in range, whereupon the procedure is repeated.

Although several systems for beacon deployment, beacon communication and beacon excitation and magnetic field sensing have been disclosed, it will be understood that they can be used in various combinations with one another to suit detailed drilling requirements.

For the SAGD application of the present invention, the detailed mathematics of the methods usefully employed for location and direction determination are well known and have been disclosed in numerous publications, such as, for example, U.S. Pat. No. 6,814,163. Algebraic manipulation of the mathematical details outlined in this patent is readily applied to the present configuration by those conversant in physics and mathematics. The following description of the salient features of this process will provide a general understanding of the method.

Figure 9:
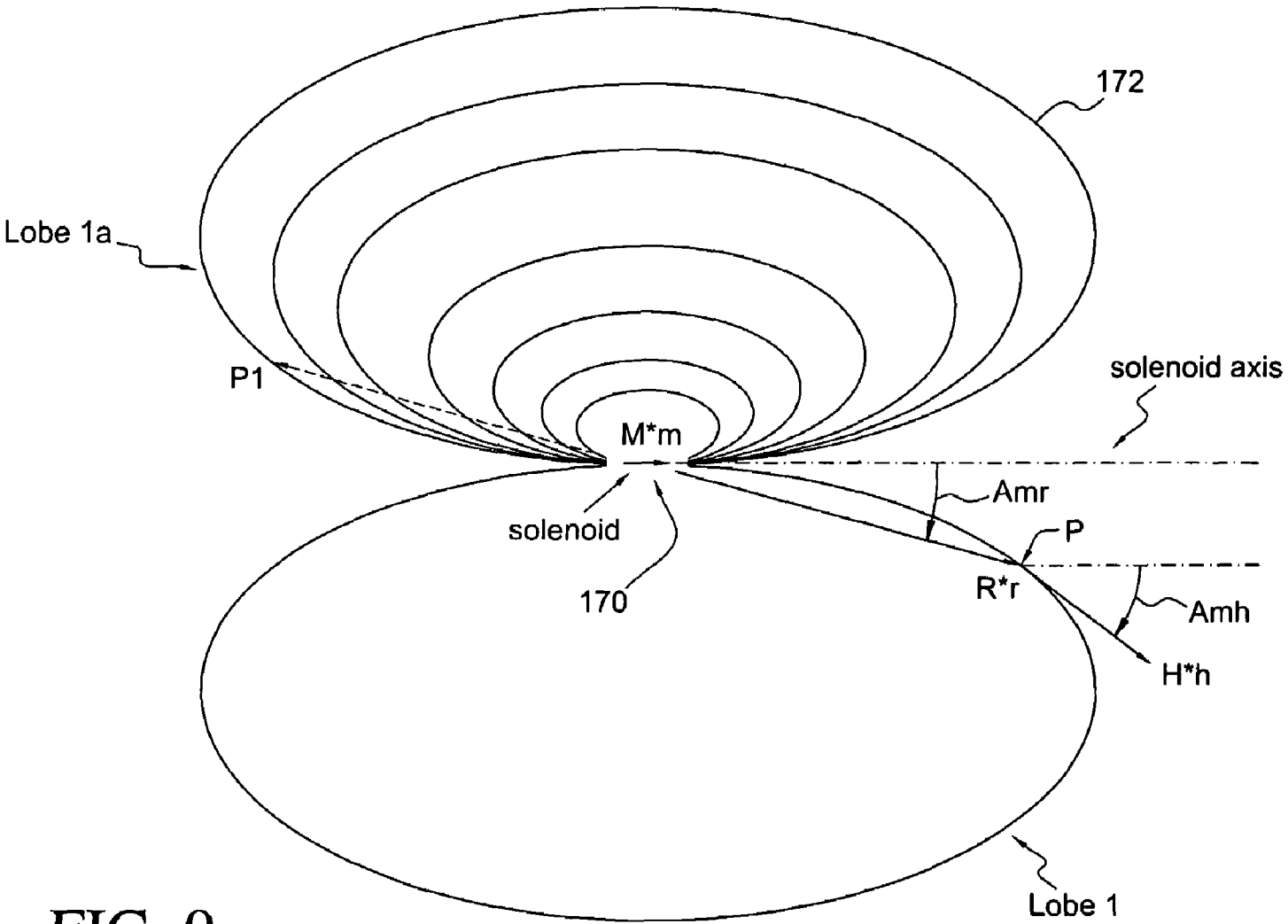
FIG. 9 illustrates magnetic field lines on the plane defined by the vectors m and h.

The overall considerations are illustrated in FIG. 9, which shows the geometry associated with the magnetic dipole field generated by a solenoid, such as the field 44 generated by the solenoid 18 in FIG. 1. The beacon under consideration can be represented mathematically to a good approximation by a magnetic dipole, i.e., it has a magnetic field geometry similar to that of a bar magnet at 170 with field lines 172, as shown in FIG. 9. The bar magnet has an axis direction m and a strength M. At any point P in space there is a spatial vector R*r, with direction r and magnitude R going from the bar magnet to the point P. At the point P there is an electromagnetic field vector H*h with direction h and magnitude H, which is measured by the MWD apparatus. The mathematical task is to derive, from the measured vector field H*h, the spatial vector R*r.

An important feature in FIG. 9 is that the three vectors characterizing the magnetic dipole direction m, the direction vector r from the dipole to the point P, and the direction of the magnetic field h, are all coplanar; i.e., the vector r lies in the plane defined by the direction vectors h and m. Thus, provided that h and m are not parallel to each other, a plane is defined in which r lies. The corollary to this is that if the observation point is "alongside" the source, where m and h are parallel, the right left, up down location of the observation point, for horizontal wells, cannot be determined.

Figure 10:
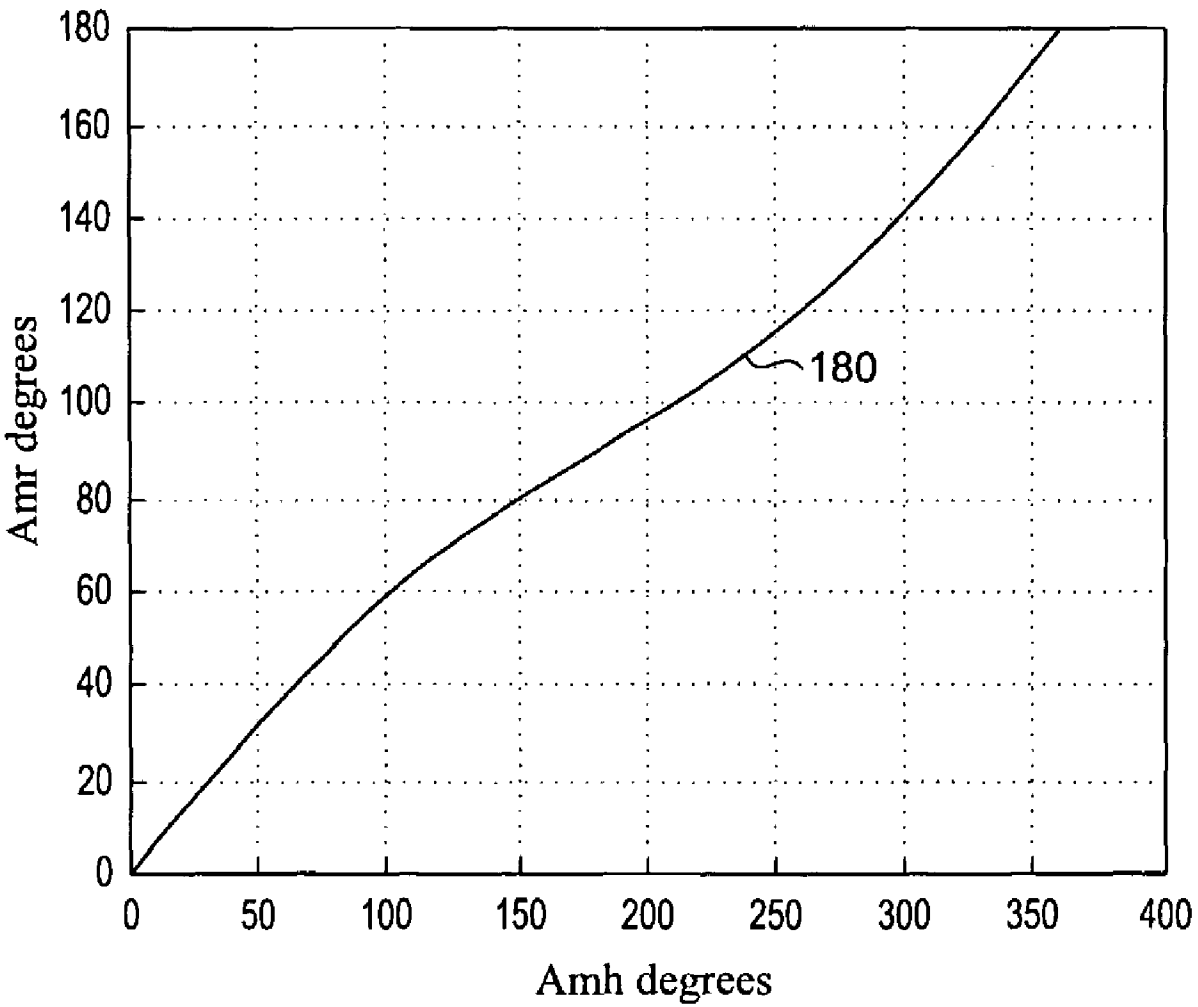
FIG. 10 is a graph for finding the angle Amr from the angle Amh.

If the three vector magnitudes, M, R and H are specified to be positive numbers, then the associated direction vectors m, r and h have the unique directions illustrated in FIG. 9. There is a unique relationship between direction h and the direction r on any "field line lobe," such as the lobe 1 shown in FIG. 9. Given the measured angle Amh of the electromagnetic field h, the angle Amr of the radius vector r can be read off by tracing a field line path from one end of the dipole out into space and back to the other pole, and this is plotted numerically by graph 180 in FIG. 10. Thus, by measuring the angle between the known vector directions h and m, the angle Amr is readily found.

The field direction and magnitude at two points P and P1, at diametrically opposite locations from the source 170, are equal. They are on separate coplanar field line lobes 1 and 1*a*, respectively. It is necessary to know at the outset which of these lobes is the correct one in order to obtain a unique location determination from the measurement of the three vector components of the electromagnetic field. For the SAGD application disclosed herein, knowing that the observation point lies above the source is a sufficient condition.

Thus, given the directions of the vectors m and h and knowledge that the observation point is at a vertical elevation higher than the elevation of the source, the direction vector r is uniquely determined. The direction vector r lies in the plane of m and h and the field line lobe in that plane must lie above the source. The angle Amr from m to r on that lobe is uniquely related to the angle Amh, i.e., the angle from m to h. Furthermore the magnitudes of R, H, M and the angle Amr are related through the relationship $$H=(M/(4*\mathrm{pi}*R^3))*\mathrm{sqrt}(3*(\cos(Amr))^2+1)$$

Thus, knowing M, H, and the angle Amr, the magnitude of R is readily found from the above equation. Important points to note are that the field magnitude H is proportional to the source strength M, and is the inverse cube of the distance R and an angle factor, which varies between 2 and 1 depending upon the angle Amr. The moment M is proportional to the current flow in the solenoid, which is proportional to the battery voltage. Since the measurement will be time integrated over the duration of the excitation, varying the length of the excitation burst inversely with the current flow compensates for this, in addition to providing a direct, remote measurement of the battery condition.

Implicit in the above discussion is not only that it is desirable to know the directions of m and h; it is usually desirable to know the sense of each, i.e., the "sign" of each. The primary purpose of the standard MWD measurements made by drillers is the precise determination of borehole direction and MWD tool roll angle at each point in the borehole and to determine these quantities at closely spaced points in the boreholes. Thus, the axial direction of the electromagnetic field direction and its sign is readily determined. The axis of the source is known, since the reference well was also surveyed at the time of drilling. Constructing the source and installing it so that, e.g., the first positive current excitation of the source generates a local field pointing down, the axis of the reference well will specify the sign of the source moment direction. The sign of the source can usually be indirectly inferred, since the along-hole depth of each borehole is precisely known. Thus, the driller usually knows whether the current observation point lies "before" or "beyond" the source. Indeed, the driller usually knows the approximate relative location of a beacon before making a measurement, based on the previous drilling history. Thus, if need be, in many cases it is not necessary to know the sign of m.

The above discussion demonstrates that the relative location of the well being drilled and the beacon can be found from measurements at each station. In practice, electromagnetic field measurements will be made and analyzed whenever the beacon is within range. Using well-known methods of data analysis and an ensemble of measurements, together with the known distance along the borehole being drilled, drilling direction data can be optimized and relative location determination of the two boreholes made more precise.

Although the invention has been described in terms of various embodiments, it will be understood that these are exemplary of the true spirit and scope of the invention as set forth in the accompanying claims.

What is claimed is:

1. Apparatus for measuring the distance and direction between two boreholes extending into the Earth, comprising:

a solenoid assembly installed at a first selected point in a first borehole, said first borehole having a known inclination and direction at said selected point;

down hole circuitry for energizing said solenoid assembly to generate a characteristic known solenoid field for a short interval of time;

electronic circuitry in said solenoid assembly which actively waits for an initiating signal and upon receipt of said initiating signal starts a prescribed electric current flow into said solenoid;

a magnetic field sensor deployed at a second selected point in a second borehole, said field sensor measuring three vector components of said characteristic solenoid magnetic field at said second point;

orientation circuitry for determining a spatial orientation of said magnetic field sensor at said second point in said second borehole; and a processor responsive to said spatial orientation of said sensor and to said measured vector components at said second point in said second borehole and further responsive to said characteristic known solenoid magnetic field to determine the distance and direction between said first and second points.

2. The apparatus of claim 1, wherein said solenoid assembly comprises a magnetic field source beacon having a coil wound on a tubing coupler.

3. The apparatus of claim 2, wherein said tubing coupler has first and second threaded ends for receiving and joining threaded lengths of tubing.

4. The apparatus of claim 3, wherein said lengths of tubing are coupled end to end to form a well casing or work string for temporary installation in a borehole.

5. The apparatus of claim 2, wherein said down hole circuitry for energizing said solenoid assembly includes telemetry communication circuitry mounted on said tubing coupler and connected to selectively energize said coil to generate said characteristic known solenoid field.

6. The apparatus of claim 5, further comprising an apparatus for remotely sending an initiating signal to said solenoid assembly including a telemetry signal source adjacent said second borehole.

7. The apparatus of claim 6, wherein said telemetry signal source comprises a source of encoded sonic initiating signals.

8. The apparatus of claim 6, wherein said telemetry signal source includes a first transducer at the Earth's surface for producing pressure pulses in said second borehole, and a downhole MWD package in said second borehole including a second transducer responsive to said pressure pulses to generate encoded sonic initiating pulses.

9. The apparatus of claim 8, wherein said MWD package incorporates said magnetic field sensor and said orientation circuitry.

10. The apparatus of claim 5, further comprising an apparatus for remotely sending an initiating signal to said solenoid assembly including a telemetry signal source at said first borehole.

11. The apparatus of claim 10, wherein said telemetry signal source comprises a percussive transmitter.

12. The apparatus of claim. 10, wherein said telemetry signal source comprises a source of electrical current.

13. The apparatus of claim 12, wherein said telemetry signal source further includes an insulated wire connected to said source of electrical current and extending into said first borehole, and wherein said telemetry communication circuitry mounted on said tubing coupler includes a detector responsive to said electrical current.

14. The apparatus of claim 12, wherein said beacon tubing coupler couples adjacent lengths of tubing in a work string for temporary installation in said first borehole, and wherein said source of electrical current is connected to said work string to produce an encoded initiating signal in said work string, and wherein said telemetry communication circuitry mounted on said tubing coupler includes a detector responsive to said encoded initiating signal in said work string.

15. The apparatus of claim 14, wherein said detector includes a toroidally wound pickup coil on said tubing coupler and connected to said telemetry communication circuitry.

16. Apparatus for measuring the distance and direction between two boreholes extending into the Earth, comprising:

a solenoid assembly installed at a first selected point in a first borehole, said first borehole having a known inclination and direction at said selected point;

apparatus for remotely sending an initiating signal to the said solenoid assembly;

electronic circuitry in said solenoid assembly which actively waits for said initiating signal and upon receipt of said initiating signal starts a prescribed electric current flow into said solenoid to generate a characteristic known magnetic field;

a magnetic field sensor deployed at a second selected point in a second borehole, said field sensor measuring three vector components of said characteristic solenoid magnetic field at said second point;

orientation circuitry for determining the spatial orientation of said magnetic field sensor at said second point in said second borehole; and a processor responsive to said spatial orientation of said sensor and to said measured vector components at said second point in said second borehole and further responsive to said characteristic known solenoid magnetic field to determine the distance and direction between said first and second points.

17. The apparatus of claim 16, wherein said solenoid assembly includes multiple magnetic field source beacons, each beacon consisting of a coil wound on a tubing coupler, and each tubing coupler having first and second threaded ends for coupling corresponding lengths of tubing.

18. The apparatus of claim 17, wherein said coupled lengths of tubing form a wall casing or work string having spaced-apart beacons.

19. The apparatus of claim 16, wherein:

said apparatus for remotely sending an initiating signal includes a source of encoded magnetic or sonic initiating signals in said second borehole; and wherein said solenoid assembly comprises multiple spaced-apart beacons located along said first borehole, said beacons being selectively activated by said encoded initiating signals to generate corresponding characteristic magnetic fields.

20. The apparatus of claim 16, wherein:

said apparatus for remotely sending an initiating signal comprises a source of pressure or electrical encoded initiating signals in said first borehole; and wherein said solenoid assembly comprises multiple space-apart beacons located along said first borehole, said beacons incorporating receiver transducers responsive to said pressure or electrical encoded initiating signals to generate corresponding characteristic magnetic fields.

21. The apparatus of claim 20, wherein said beacons are powered by batteries mounted on said solenoid assembly.

22. The apparatus of claim 20, further including a remote DC or AC power supply for said beacons located at the Earth's surface and further including a current supply wire in said first borehole and coupled to said beacons.

23. A method for measuring the distance and direction between two boreholes extending into the Earth, comprising:

installing a solenoid assembly at a first selected point in a first borehole, said first borehole having a known inclination and direction at said selected point;

deploying a magnetic field sensor at a second selected point in a second borehole for measuring magnetic field and gravity vector components at said second point in said second borehole;

determining the spatial orientation of said magnetic field sensor at said second point in said second borehole;

providing electronic circuitry in said solenoid assembly which actively waits for an initiating signal and upon receipt of said initiating signal starts an electric current flow into said solenoid to generate a characteristic known solenoid field;

remotely sending an initiating signal to the said solenoid assembly to cause said assembly to generate said characteristic field;

sensing said characteristic field with said sensor at said second point in said second borehole; and determining the distance and direction between said first and second points using said spatial orientation of said sensor and a measured vector component of said characteristic known solenoid magnetic field.

24. The method of claim 23 further comprising:

determining the distance and direction between multiple pairs of points between said first and second boreholes; and maintaining substantial uniformity of the distance and direction of said multiple pairs of points.

25. The method of claim 23 further comprising:

sending the distance and direction to a remote computer; and using the distance and direction to maintain said first and second boreholes in a substantially parallel relationship.

26. Apparatus for measuring the distance and direction between two boreholes extending into the Earth, comprising:

multiple tubing couplers having first and second ends for connection to corresponding lengths of tubing along a first borehole;

a coil wound around each of said tubing couplers;

telemetry communication circuitry mounted on each of said tubing couplers and connected to said coil, said circuitry including a detector responsive to initiating signals to selectively activate said coil to generate a characteristic magnetic field;

a magnetic field sensor disposed in a second borehole, said magnetic field sensor having a spatial orientation; and a processor to receive said spatial orientation and said characteristic magnetic field of each of said selectively activated coils to maintain a relationship between said first and second boreholes while said second borehole is being drilled.

27. The assembly of claim 26, wherein said detector comprises a toroidal pickup coil.

28. The assembly of claim 26, further including multiple tubing couplers connecting corresponding lengths of tubing end-to-end to provide an elongated well casing or well work string having spaced-apart couplers for insertion into a borehole.

29. The assembly of claim 26, wherein said detector comprises a transducer responsive to remotely generated sonic, magnetic, or electrical current initiating signals.

30. A method for measuring the distance and direction between two boreholes extending into the Earth, comprising:

installing a tubing coupler in a first borehole to connect multiple downhole tubulars;

transmitting telemetry signals to circuitry in said coupler;

detecting said telemetry signals in said coupler;

activating a coil in said coupler in response to said telemetry signals;

generating a characteristic magnetic field with said coil;

receiving said magnetic field using a magnetic field sensor in a second borehole;

determining a spatial orientation of said magnetic field sensor;

measuring a vector component of said magnetic field using said magnetic field sensor; and determining the distance and direction between said first and second boreholes using said spatial orientation and said vector component.

31. Apparatus for measuring the distance and direction between two boreholes extending into the Earth, comprising:

a solenoid assembly installed at a first selected point in a first borehole, said first borehole having a known inclination and direction at said selected point;

electronic circuitry in said solenoid assembly to receive an initiating signal and start an electric current flow into said solenoid to generate a magnetic field;

a magnetic field sensor deployed at a second selected point in a second borehole, said field sensor measuring at least one vector component of said magnetic field at said second point;

orientation circuitry for determining a spatial orientation of said magnetic field sensor at said second point in said second borehole; and a processor to receive said spatial orientation of said sensor and said measured vector component to calculate the distance and direction between said first and second points.

32. The apparatus of claim 31 further comprising:

a plurality of solenoid assemblies disposed at spaced-apart locations in said first borehole;

said processor to calculate the distance and direction between a plurality of pairs of points between said first and second boreholes; and a remote computer to maintain a substantial uniformity of the distance and direction of said plurality of pairs.

33. The apparatus of claim 31 further comprising a remote computer to receive the calculated distance and direction and maintain a substantially parallel relationship between said first and second boreholes.

* * * * *